US007743625B2

(12) United States Patent
Schock

(10) Patent No.: US 7,743,625 B2
(45) Date of Patent: Jun. 29, 2010

(54) NATURAL SMOKE/FOG DISTRIBUTION SYSTEM

(75) Inventor: William Schock, Santa Maria, CA (US)

(73) Assignee: William R. Schock, Santa Maria, CA (US)

( * ) Notice: Subject to any disclaimer, the term of this patent is extended or adjusted under 35 U.S.C. 154(b) by 666 days.

(21) Appl. No.: 11/182,586

(22) Filed: Jul. 14, 2005

(65) Prior Publication Data

US 2007/0012065 A1 Jan. 18, 2007

(51) Int. Cl.
*F25D 3/02* (2006.01)

(52) U.S. Cl. ..... 62/425

(58) Field of Classification Search ..... 62/425, 62/387, 404, 419

See application file for complete search history.

(56) References Cited

U.S. PATENT DOCUMENTS 4,811,901 A * 3/1989 Stevens et al. ..... 239/138
4,818,843 A * 4/1989 Swiatosz ..... 392/397
4,934,601 A * 6/1990 Stevens et al. ..... 239/138
5,957,382 A * 9/1999 Thomas ..... 239/135
6,805,307 B2 * 10/2004 Dorendorf et al. ..... 239/398

* cited by examiner

*Primary Examiner*—Melvin Jones

(57) ABSTRACT

A method for use with a cold fog generator and/or smoke/fog distribution system comprising the steps of: (a) injecting expanding smoke into an inlet orifice utilizing a venturi effect to foster the full expansion of smoke once inside chamber, thereby (b) introducing smoke into an expansion chamber that will complete its expansion process, (c) building air pressure within expansion chamber and thereby harnessing natural energy from expanding gases to then (d) force said smoke through an ice mass thereby (e) cooling the smoke and creating fog, then (f) forcing fog/smoke out of cfgnsfds via an exhaust duct.

In another preferred method the steps are as follows: (a) injecting expanding smoke into an inlet orifice utilizing a venturi effect to foster the full expansion of smoke once inside chamber, thereby (b) introducing smoke into an expansion chamber that will complete its expansion process, (c) building air pressure within expansion chamber and thereby harnessing natural energy from expanding gases to then (d) force fog/smoke out of cfgnsfds via an exhaust duct.

2 Claims, 11 Drawing Sheets

NATURAL SMOKE/FOG DISTRIBUTION SYSTEM

CROSS-REFERENCE TO RELATED APPLICATIONS

A COLD FOG GENERATOR AND/OR NATURAL SMOKE/FOG DISTRIBUTION SYSTEM;

A ONE WAY VENTURI FOR USE WITH A COLD FOG GENERATOR AND/OR NATURAL SMOKE/FOG DISTRIBUTION SYSTEM

FIELD OF THE INVENTION

The present invention is in the area of smoke machines and pertains more particularly to methods, apparatus, and systems for generating fog, flash freezing smoke and disbursing both to a remote location.

BACKGROUND OF THE INVENTION

Many entertainment events and other uses for smoke call for a heavy, thick, and low-lying fog effect. In order to produce a low-lying fog effect from a fluid smoke machine which will roll low over the ground, the smoke must be cooled significantly. If the hot smoke is not cooled significantly, it will rise, spread and dissipate. However, since smoke producing machines produce smoke at around 165°-200°, it quickly rises and dissipates if left unchanged.

Therefore, what is clearly needed in the art is a system, apparatus, and methods thereof for producing a low-lying fog effect which is cooled such that the fog and/or smoke will remain low over the ground and will not quickly rise and dissipate.

SUMMARY OF THE INVENTION

A method for use with a Cold Fog Generator and/or Natural Smoke/Fog Distribution System (cfgnsfds) comprising the steps of: (a) injecting expanding smoke into an inlet orifice utilizing a venturi effect to foster the full expansion of smoke once inside chamber, thereby (b) introducing smoke into an expansion chamber that will complete its expansion process, (c) building air pressure within expansion chamber and thereby harnessing natural energy from expanding gases to then (d) force said smoke through an ice mass thereby (e) cooling the smoke and creating fog, then (f) forcing fog/smoke out of cfgnsfds via an exhaust duct and out to desired location.

In another preferred method the steps are as follows: (a) injecting expanding smoke into an inlet orifice utilizing a venturi effect to foster the full expansion of smoke once inside chamber, thereby (b) introducing smoke into an expansion chamber that will complete its expansion process, (c) building air pressure within expansion chamber and thereby harnessing natural energy from expanding gases to then (d) force fog/smoke out of cfgnsfds via an exhaust duct and out to desired location.

BRIEF DESCRIPTION OF THE DRAWING FIGURES

DESCRIPTION OF PREFERRED EMBODIMENTS

According to a preferred embodiment of the present invention, a unique system, method, and apparatus is used to deliver a cold and low-lying fog effect. The present invention is described in enabling detail below.

Figure 1:
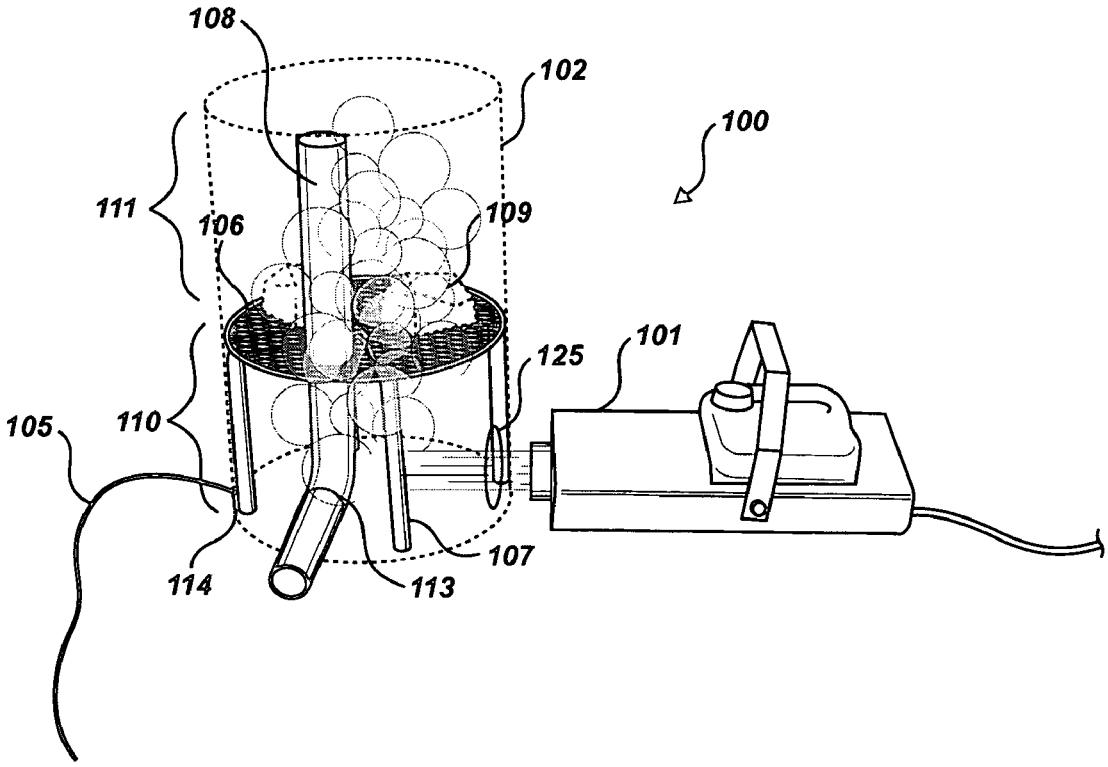
FIG. 1 is an isometric view of a preferred embodiment of the present invention.
Figure 2:
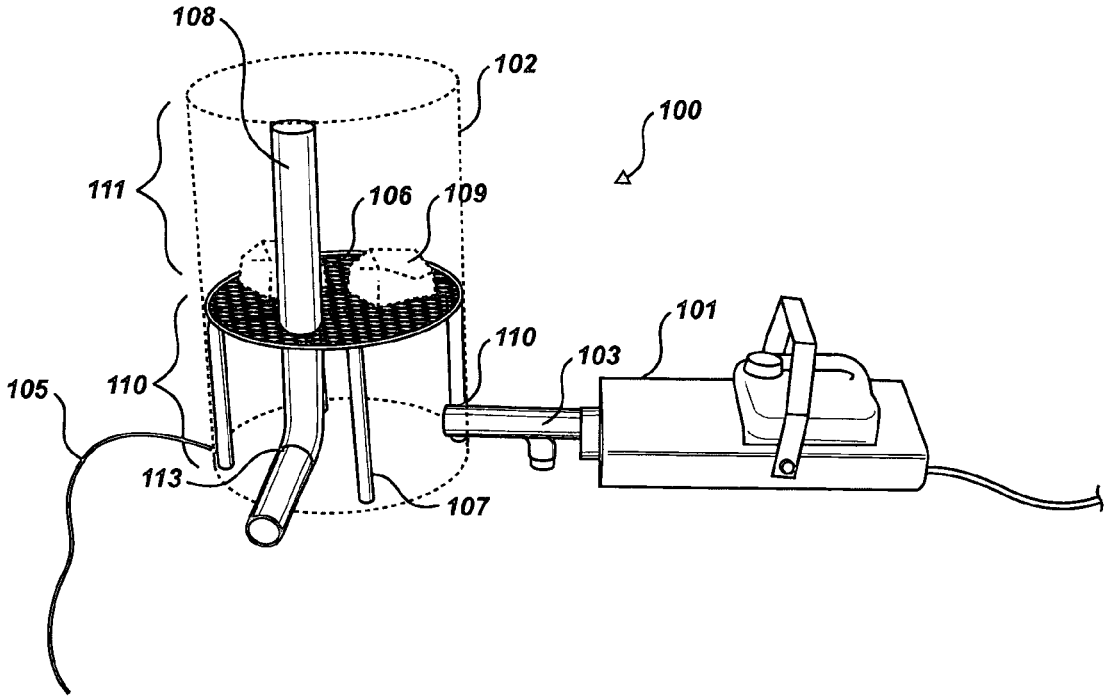
FIG. 2 is an isometric view of a preferred embodiment of the present invention.
Figure 11:
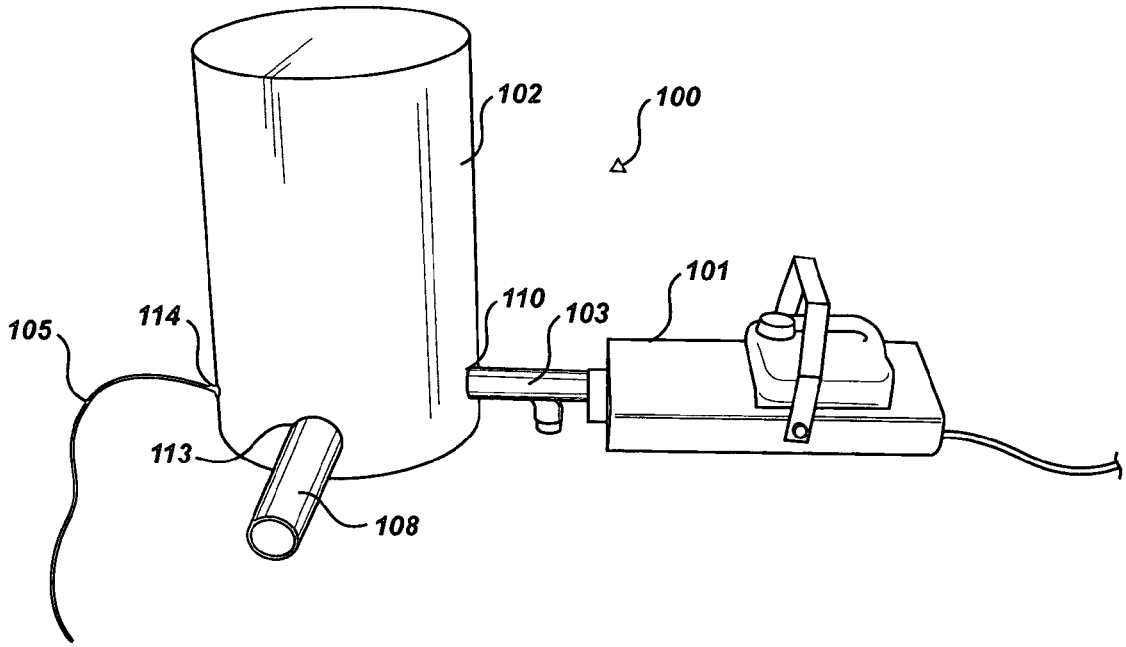
FIG. 11 is an isometric view of a preferred embodiment of the present invention.

FIG. 1 is a perspective view of a preferred embodiment of the present invention. Cold fog generator and smoke/fog distribution system 100 (hereafter cfgds) comprises a smoke machine 101, a chamber 102, an inlet orifice 125, (or in some preferred embodiments a one-way venturi 103 as illustrated in FIG. 11), and tubing 105. FIG. 2 illustrates the remaining elements: an ice tray 106, support apparatus 107, exhaust duct 108, ice 109, expansion chamber 110 and flash freeze chamber 111.

It should be pointed out here that cfgnsfds 100 in some preferred embodiments is a sealed system. In other preferred embodiments, cfgnsfds 100 is a semi-sealed system. Although cfgnsfds 100 possesses orifices, it is to be understood that the mentioning of these orifices is for the purpose of fabrication of the present invention. System relies on the friction that is created by the inletting of fog into expansion chamber to push fog through opposing orifice to the inlet.

It should also be pointed out that the venturi apparatus is optional. In FIG. 1, embodiment #1 no venturi apparatus 103 is used. FIG. 2 illustrates another preferred embodiment where a venturi apparatus 103 is used. Either embodiment may accomplish the desired objectives.

Ice 109 is used for the purpose of cooling the smoke thereby enabling a low-lying fog-effect. In some preferred embodiments, ice 109 may be either regular ice or dry ice. For the purposes of clarity, the term ice 109 shall refer to both regular ice or dry ice.

Chamber 102 is a container with three orifices 125, 113, and. Inlet orifice 125 is where the smoke is directed through. Orifice 114 is where melting ice water drains from the chamber 102. And orifice 113 is where fog exits from cfgnsfds 100.

Inside the chamber 102 is the exhaust duct 108. Exhaust duct 108 passes through wall of chamber 102 through orifice 113. From the point of attachment, exhaust duct 108 has a length such that it traverses the height of both support apparatus 107 and ice tray 106. Exhaust duct 108 in a preferred embodiment is made of a garden-variety PVC piping material. However other materials and pipes may be equally expedient to constitute the exhaust duct 108. Therefore, the specific material and apparatus used to constitute the exhaust duct 108 is of no consequence.

Smoke machine 101 is the apparatus which produces the smoke. There abound many different types of smoke machines with which cfgnsfds 100 may be adapted to work. In other preferred embodiments, smoke machine 101 is attached to the one-way venturi 103. In turn, the one-way venturi 103 is attached to orifice 110 of expansion chamber 102. And in some preferred embodiments such as what is illustrated in FIG. 1, smoke machine 101 is simply pointed towards inlet orifice 125 in order to introduce smoke into the cfgnsfds 100.

In a preferred embodiment, inlet orifice 125 is the point where smoke is introduced into cfgnsfds 100. Inlet orifice 125 is placed near smoke machine 101 such that most of the smoke will be introduced into cfgnsfds 100. This distance may be anywhere between 1 inch to several inches.

Figure 5:
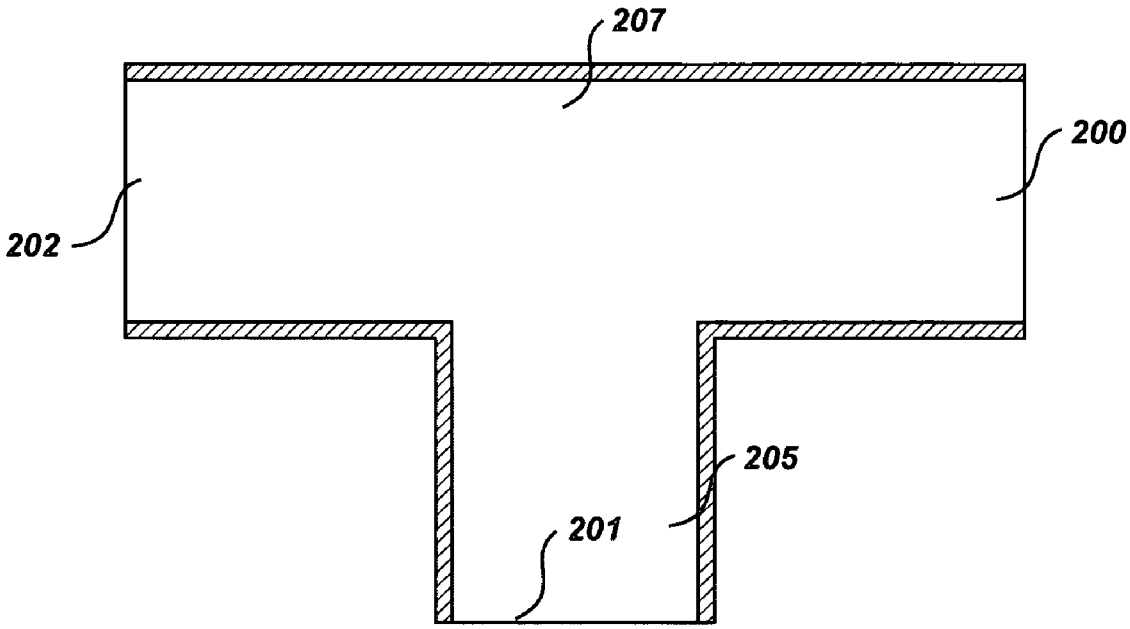
FIG. 5 is an isometric view of a preferred embodiment of the present invention.
Figure 6:
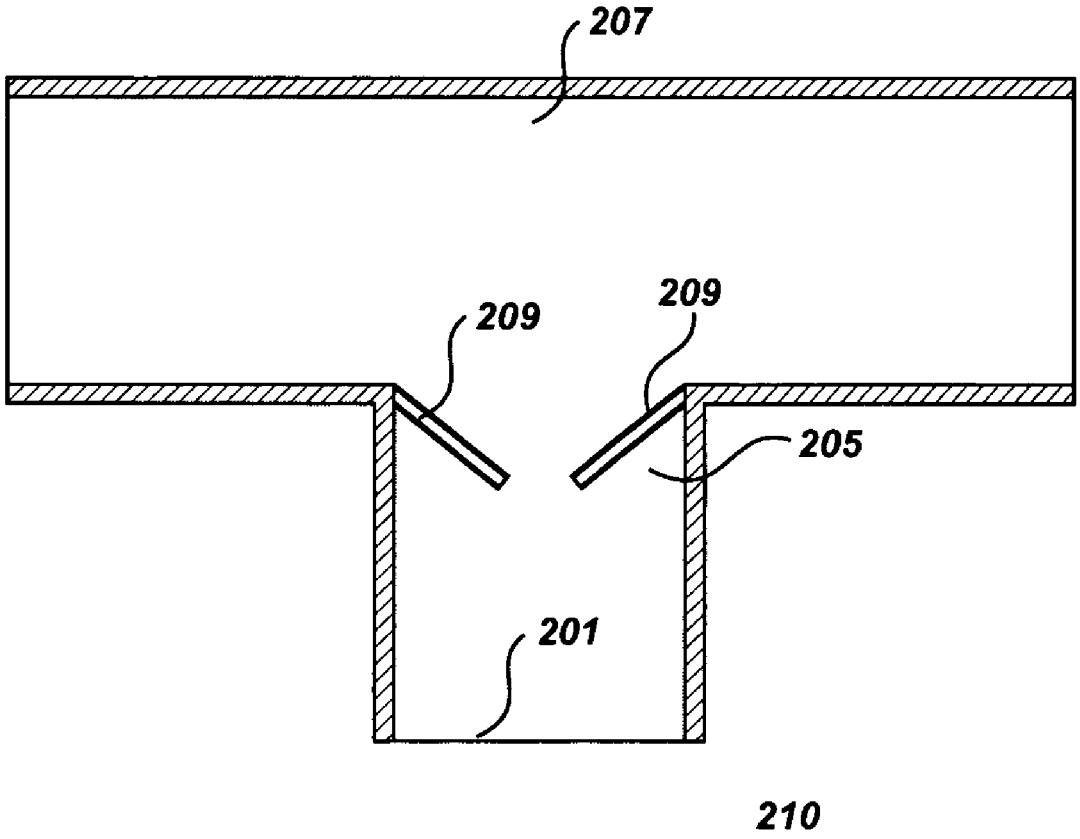
FIG. 6 is an isometric view of a preferred embodiment of the present invention.
Figure 7:
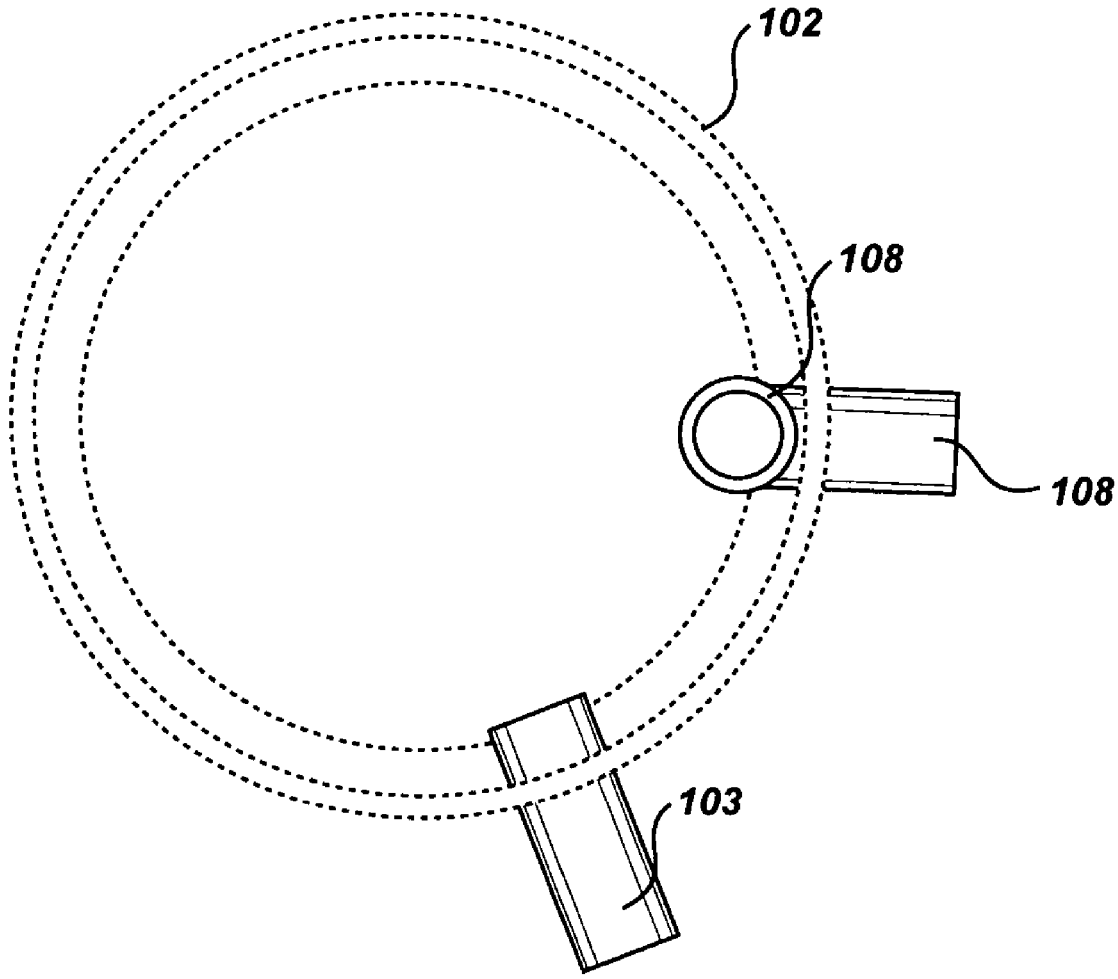
FIG. 7 is an isometric view of a preferred embodiment of the present invention.

As discussed above, the use of a one way venturi 103 is optional in some preferred embodiments. One-way venturi 103 is the one-way conduit by which smoke machine 101 may deliver smoke into the chamber 102. As seen in FIGS. 5 and 6, one way venturi 103 possesses three orifices, 200, 201, and 202. Orifice 200 attaches to the smoke machine 101. Orifice 202 attaches to orifice 110 of the expansion chamber 102 via the one way venturi 103. Orifice 201 is the conduit for outside air to flow into chamber 102. Orifice 201 is also the entry point to gate chamber 205. Gate chamber 205 is where air flow is impeded using various means.

In preferred embodiments, the function of shutting down smoke flow from gate chamber 205 is accomplished through gate means 209, a trap door means, a spring means, reeds etc. A skilled artisan within the art will be able to enable a spring means, trap door means, or other means of shutting down air flow from expansion chamber 102. Therefore, the specific details shall not be detailed herein.

In order to attach the one-way venturi 103 to expansion chamber via orifice 110 both orifice 110 and one-way venturi 103 may be complimentarily threaded and sized to fit each other. However, it is not specifically required that the mode of attachment is via threading. Other modes of attachment such as gluing, soldering, etc. are equally expedient for the task, and will be readily understood by one skilled in the art.

Chamber 102 is a semi-sealed container and may embody many different shapes and sizes. FIG. 2 illustrates that chamber 102 comprises both the expansion chamber 110 and the flash freeze chamber 111. The expansion chamber 110 in this specification shall mean the region of the chamber 102 below the ice tray 109. The region above ice tray 109 is the flash freeze chamber 111.

The main purpose of the expansion chamber 110 is to provide the natural engine for pushing out the smoke. Since the present invention does not use fans or other exhaust means in order to inject smoke out of cfgnsfds 100, the expansion chamber 110 must accomplish this function. Expansion chamber 110 works by allowing pressure to build up naturally within expansion chamber 110 thereby forcing smoke and fog out of exhaust duct 108 and out to desired location.

The main function of flash freeze chamber 111 is to cool the smoke. The cooling of the smoke accomplishes two main objectives. First, a cold smoke is more apt to lie low over the ground, which is desirable in the entertainment industry. Second, by cooling the smoke fog is thereby created by utilizing the compression pressure from the expanding smoke.

Figure 8:
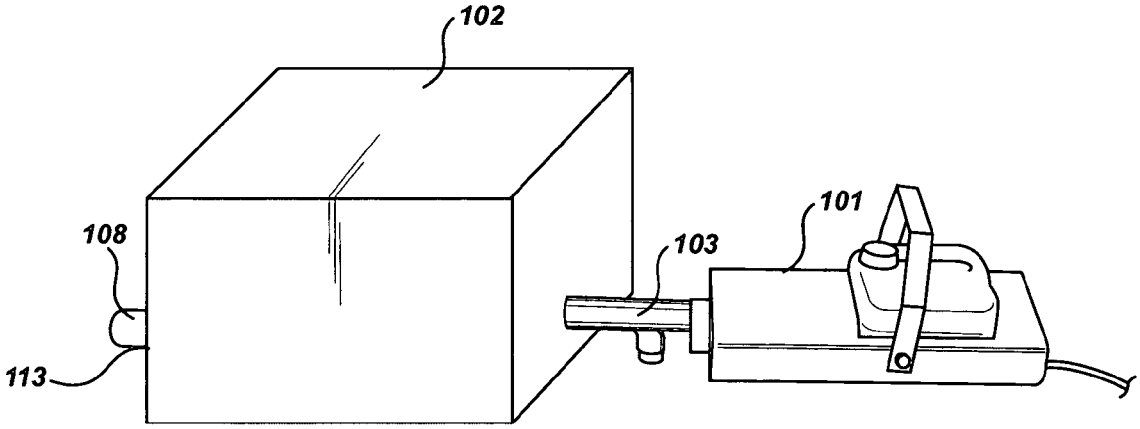
FIG. 8 is an isometric view of a preferred embodiment of the present invention.
Figure 9:
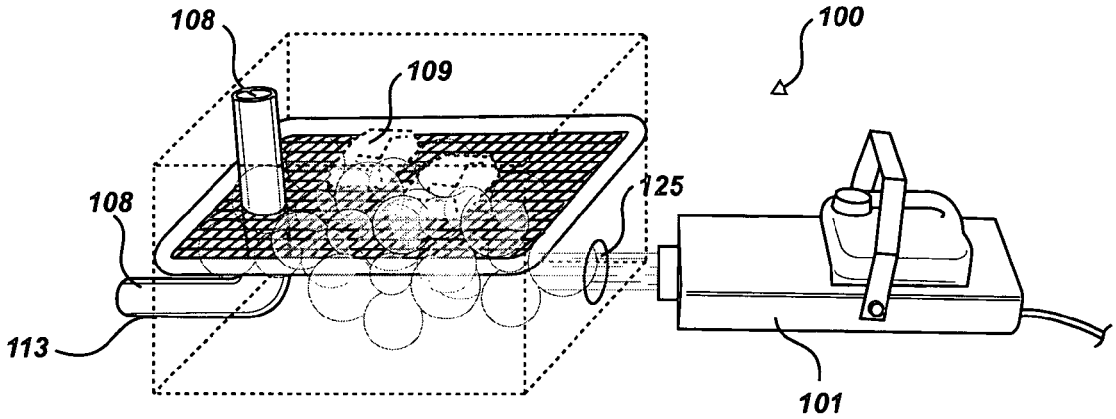
FIG. 9 is an isometric view of a preferred embodiment of the present invention.

FIGS. 8 and 9 illustrates an alternative preferred embodiment of the chamber 102. Chamber's 102 size and shape will be dictated primarily by factors of portability, capacity, and economic factors. Materials used to compose chamber 102 in a preferred embodiment is a plastic material. However, other equally expedient materials may also comprise chamber 102.

Figure 3:
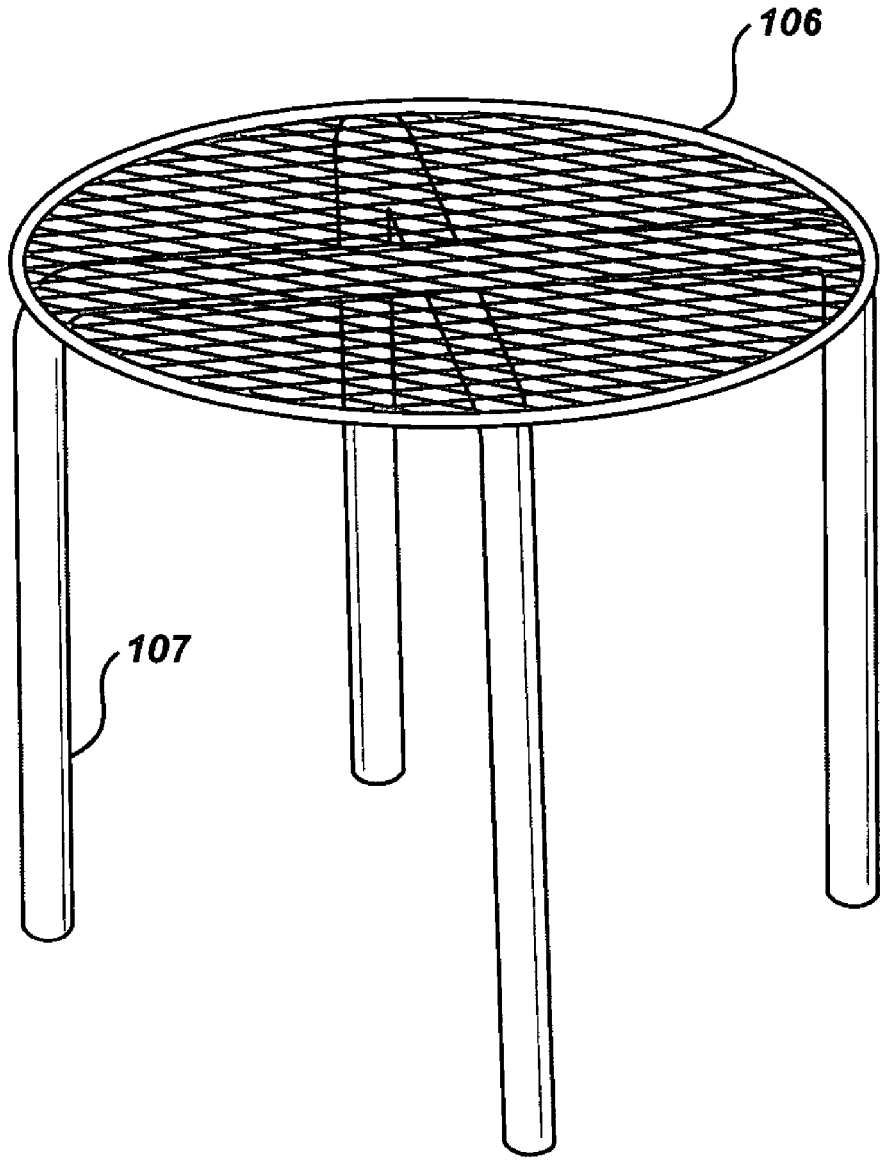
FIG. 3 is an isometric view of a preferred embodiment of the present invention.
Figure 4:
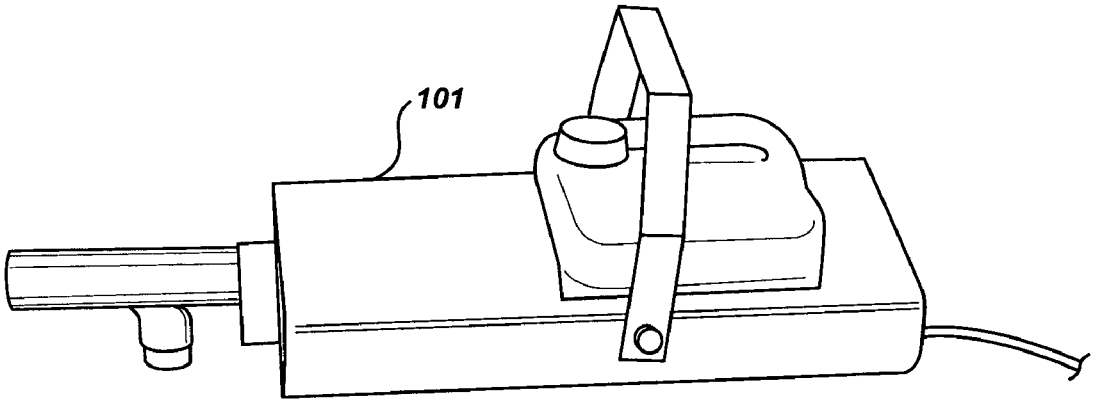
FIG. 4 is an isometric view of a preferred embodiment of the present invention.

Located in chamber 102 is the support apparatus 107 as seen in FIGS. 2 and 3. Support apparatus 107 is used for supporting ice tray 106 and ice 109. Although support apparatus 107 in a preferred embodiment is made of PVC piping material, other equally expedient means for supporting ice tray 106 and ice 109 abound. For instance, flanges may be affixed to the inside walls of chamber 102 to support both ice 109 and ice tray 106. In other preferred embodiments ice tray 106 may be affixed to walls of chamber 102 by soldering, glue, additional orifices in chamber 102, etc. The number of alternative embodiments for support apparatus 107 are endless. Therefore, the specific means for support apparatus 107 is of no consequence to the present invention.

Ice tray 106 consists of a grill-like article of manufacture. Ice tray 106 supports ice 109. Ice tray 106 may embody a panoply of different shapes and sizes. In a preferred embodiment, ice tray 106 is made of a lightweight metal. However, in other preferred embodiments, ice tray 106 may be made of plastic or other suitable material. In addition, ice tray 106 may also be a net of flexible material. The possibilities are endless. Thus, the specific means by which the ice 109 is supported is of no consequence.

Figure 10:
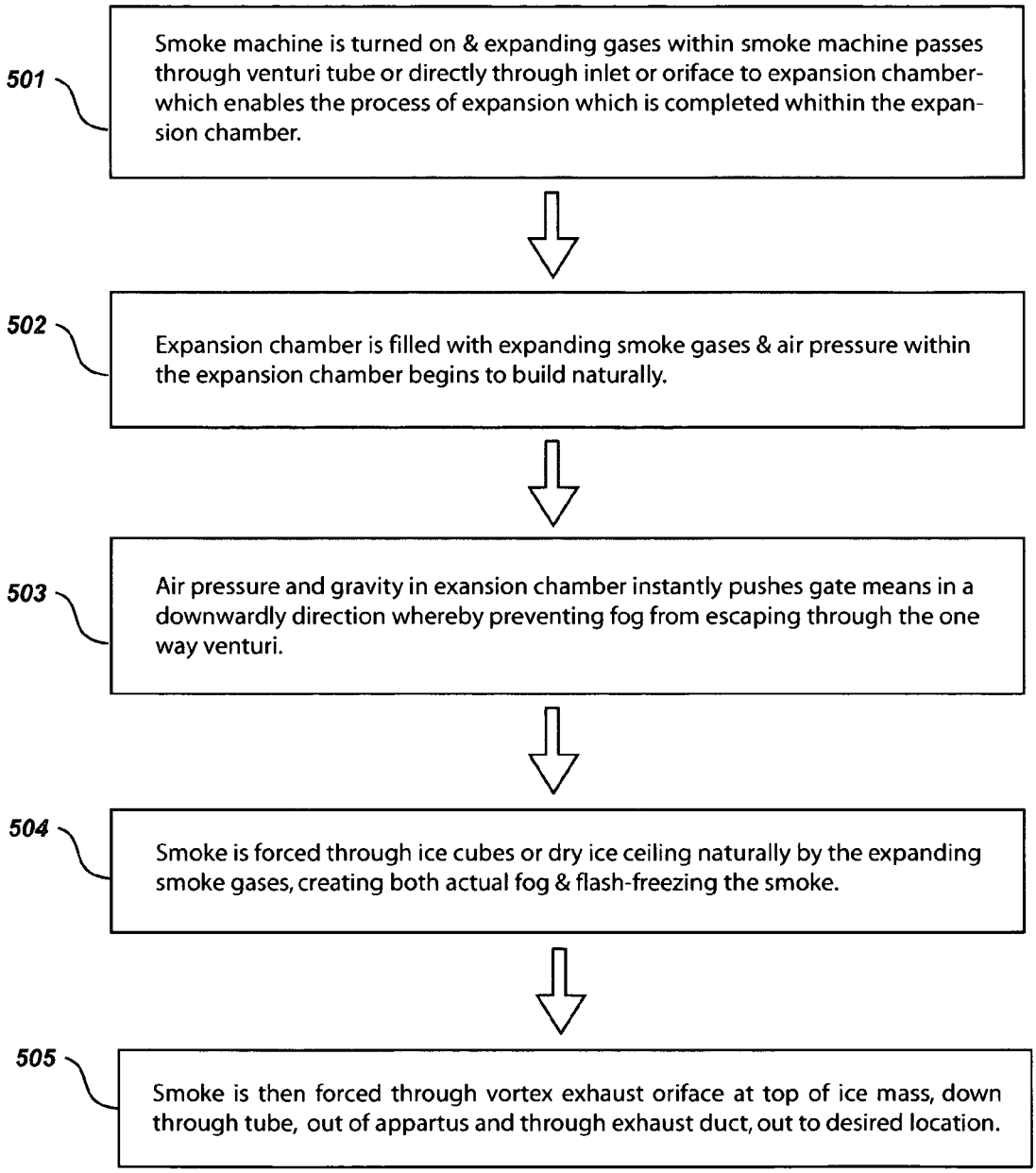
FIG. 10 is a flow diagram of a preferred embodiment of the present invention.

FIG. 10 illustrates a preferred method to be used in conjunction with the present invention. In step one 501, smoke machine 101 is turned on and the expanding gases within smoke machine 101 passes through venturi apparatus 103 or inlet orifice 125 which enables the process of expansion which is completed within expansion chamber 102. This step facilitates the expansion of smoke within the pressure chamber 110. In step two 502, expansion chamber 102 is filled with expanding smoke gases and air pressure within the expansion chamber 110 begins to build naturally. In step three, 503 air pressure in expansion chamber 110 instantly pushes gate means 209 to a closed position thereby preventing smoke from escaping through the one-way venturi 103 (in embodiments which utilize the one way venturi 103). In other preferred embodiments, this step may be accomplished via spring means and may also be accompanied with another electrical apparatus for the purpose of closing off the gate means. This step also facilitates the expansion of the smoke within the expansion chamber 110. This step also harnesses natural pressure from expanding smoke gases inside the expansion chamber 110 which is the main engine in forcing smoke out of the expansion chamber 110. In step four 504, smoke is forced through ice cubes or dry ice ceiling naturally by the expanding smoke gases, creating both actual fog and flash freezing the smoke. Eventually these natural forces result in fog and smoke to find its way out of cfgnsfds 100 via vortex orifice and out from the exhaust duct 108 to desired location.

It will be apparent to the skilled artisan that there are numerous changes that may be made in embodiments described herein without departing from the spirit and scope of the invention. For instance, instead of using regular ice or dry ice to cool the smoke or fog, a refrigerator or other cooling means may be used to cool the fog. The ways of cooling the fog are endless. As such, the invention taught herein by specific examples is limited only by the scope of the claims that follow.

What is claimed is:

1. A method for use with a cold fog generator and/or smoke/fog distribution system comprising the following steps:

(a) turning on a smoke producing means and injecting smoke into a venturi apparatus and into an expansion chamber (b) building air pressure within said expansion (c) cooling smoke with ice (d) generating increasing air pressure within said expansion chamber (e) forcing smoke naturally out of cold fog generator and delivery system, or expansion chamber when no ice is used, through an exhaust duct (f) distributing smoke out to desired location without fans.

2. The method of claim 1 wherein said cold fog generator and smoke/fog distribution system comprises: a semi sealed expansion chamber with three orifices, an exhaust duct, an inlet orifice, an ice tray, a support apparatus, ice or dry ice, a smoke producing machine, said exhaust duct located within said semi sealed expansion chamber, said exhaust duct being affixed to said orifice on lower portion of said semi sealed expansion chamber, said exhaust duct extending from said orifice up to and above said support apparatus, said ice tray, and said ice, said ice tray being supported by said support apparatus, and said ice being supported by said ice tray, said exhuast duct is attached to said orifice, said smoke producing means connected with said semi sealed expansion chamber through said inlet orifice.

* * * * *